United States Patent [19]

Bibler

[11] 4,069,851

[45] Jan. 24, 1978

[54] METHOD AND APPARATUS FOR PROCESSING LOGS

[75] Inventor: David R. Bibler, Russellville, Ark.

[73] Assignee: Bilber Brothers Inc., Russellville, Ark.

[21] Appl. No.: 614,656

[22] Filed: Sept. 18, 1975

[51] Int. Cl.[2] ..... B27B 1/00

[52] U.S. Cl. ..... 144/312; 83/102; 144/3 R; 209/73; 209/82

[58] Field of Search ..... 209/82, 88 R, 73, 74 R, 209/90; 214/16 B; 144/2 R, 1 R, 3 R, 312, 309 R; 83/78, 79, 94, 13, 102, 105

[56] References Cited

U.S. PATENT DOCUMENTS

| | | | |
|---|---|---|---|
| 3,456,700 | 7/1969 | Ahlstedt | 144/312 |
| 3,502,123 | 3/1970 | Golick et al. | 144/312 X |
| 3,650,307 | 3/1972 | Johnson | 144/2 R X |
| 3,815,738 | 6/1974 | Sweet et al. | 209/82 |

FOREIGN PATENT DOCUMENTS

| | | | |
|---|---|---|---|
| 257,771 | 11/1963 | Australia | 144/312 |

*Primary Examiner*—Harrison L. Hinson
*Assistant Examiner*—W. D. Bray
*Attorney, Agent, or Firm*—Hubbard, Thurman, Turner, Tucker, & Glaser

[57] ABSTRACT

A method, and apparatus operating in accordance therewith, for processing logs prior to their being processed by a saw mill. The logs are cut to length and then sorted and stored according to their diameters and wood types. Undersized logs and other scrap or waste pieces are processed to be sold as material either for fuel or paper pulp.

13 Claims, 6 Drawing Figures

| | |
|---|---|
| FIG. 2A | FIG. 2B |
| FIG. 2C | FIG. 2D |

METHOD AND APPARATUS FOR PROCESSING LOGS

BACKGROUND OF THE INVENTION

This invention relates to the processing of logs by a saw mill and in particular to a method and apparatus for processing the logs prior to their being sent to the saw mill for cutting into commercial lumber.

Virtually all present day lumber mills operate on an in-line conveyor belt basis. Logs are placed end to end on a conveyor belt. As a log is transported by the belt, it goes through a debarker, past saws where the log is cut into sections of desired length, and then is fed into a chipping saw where the log is cut into slices of desired width. The logs carried by the conveyor belt are not necessarily of approximately the same size. Therefore, to process the logs with minimum waste, the chipping saw must be adjusted for each log. If there is a great disparity in diameter of adjacent logs, one log cannot enter the chipping saw until the preceding log has completely passed through the saw and then the saw readjusted.

It is also a common practice for the trucks hauling the logs from the forest to the mill yard to dump their loads of logs at selected locations around the yard. No attempt is normally made to process the logs to any extent until the logs are placed on a conveyor leading to the mill, as described above. Approximately 30% of the raw log material stored in a typical yard does not end up as usable lumber, but is waste material of various types. Compounding the above, the U.S. Forest Service has enacted a requirement that all tree stems at least 2½ inches in diameter and 5 feet long must be removed from the forest. This adds to the amount of log material that cannot be turned into usable lumber.

It would therefore appear desirable to sort the logs by size and type prior to their entering the saw mill so that the processing efficiency is increased. It would also be desirable to remove scrap and other non-usable logs from the system before entering the saw mill.

SUMMARY OF THE INVENTION

In accordance with the principles of this invention, a method, and apparatus operating in accordance therewith, is provided for processing logs when first received into the mill yard. The logs are sorted by size and the hard wood separated from the pine. Scrap materials are processed at this time into material suitable for use by paper pulp mills or materials useful for fuel. Accordingly, all of the stored logs are suitable for being sawed into lumber and are grouped according to size and type, thereby permitting logs of uniform size to be fed into the saw mill, increasing the mill's efficiency.

The process is initiated by separating logs with greater than a predetermined diameter from logs with less than the predetermined diameter. The larger diameter logs are sent down a first processing line where they are cut to length and sorted as to type and size. The smaller diameter logs are transferred to a second processing line where they are cut to length and sorted as to type and size, all logs of a smaller than predetermined diameter passing down the second processing line to a trash processing line. All scraps from both the first and second processing lines, including bark and sawdust, are also sent to the trash processing line. The trash processing line converts the scrap and undersized logs into material suitable for fuel and paper pulp.

DESCRIPTION OF THE DRAWING

The foregoing will be more readily apparent upon reading the following description in conjunction with the drawing in which.

DESCRIPTION OF THE PREFERRED EMBODIMENT

Figure 1:
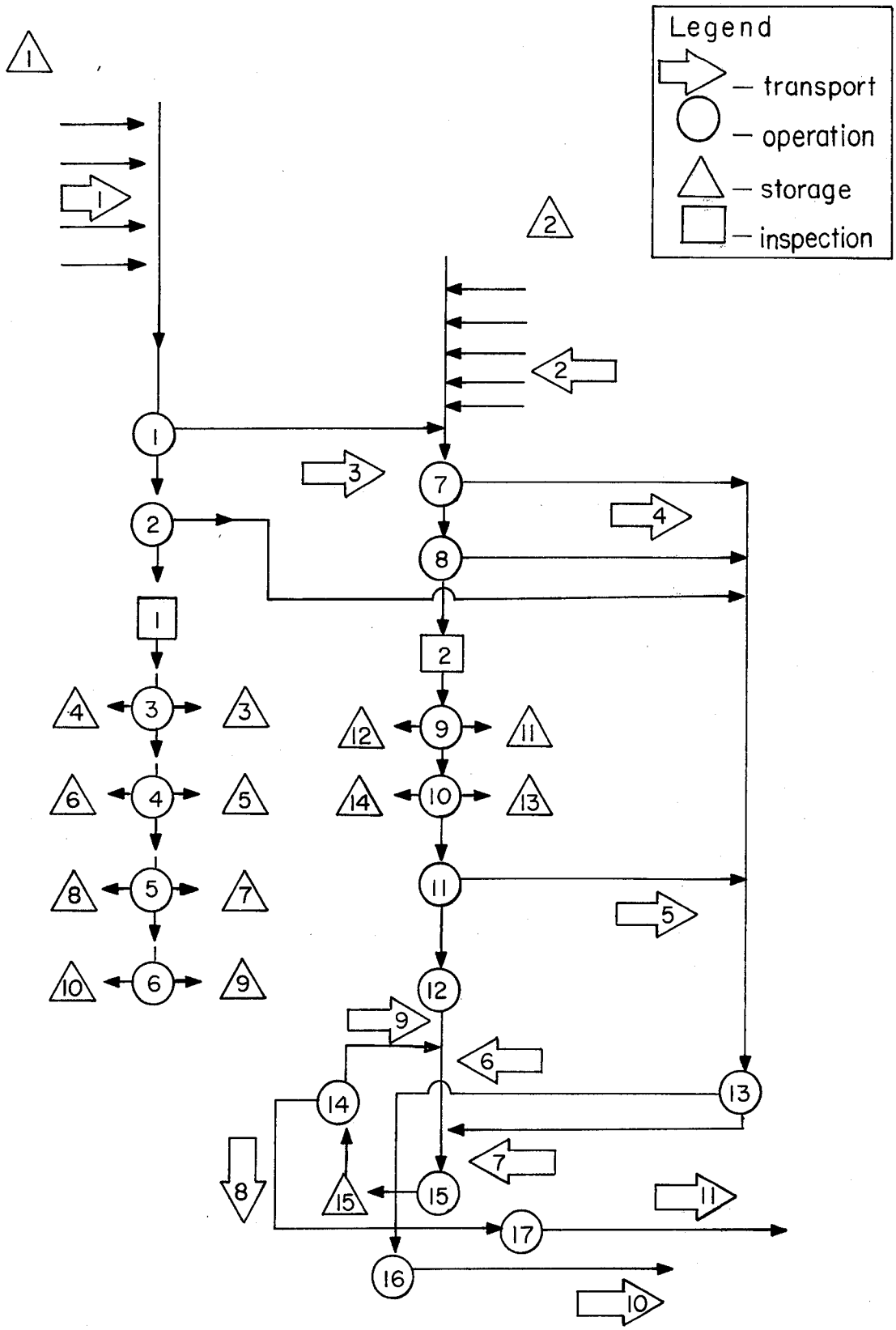
FIG. 1 depicts a flow chart of a method for processing logs in accordance with the principles of this invention.
Figures 2, 2D:
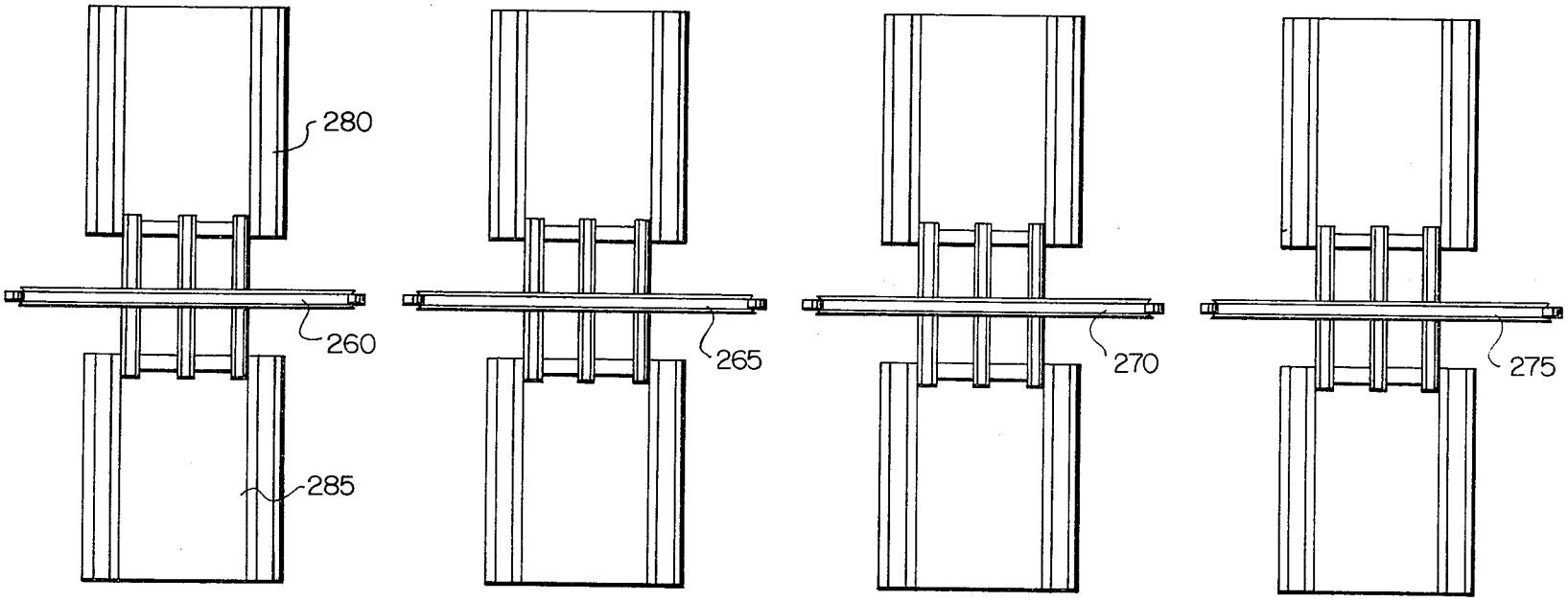
FIGS. 2A – 2D, when arranged as shown in FIG. 2, depict a schematic plan view of apparatus operating in accordance with the method of the flow chart of FIG. 1.
Figure 2A:
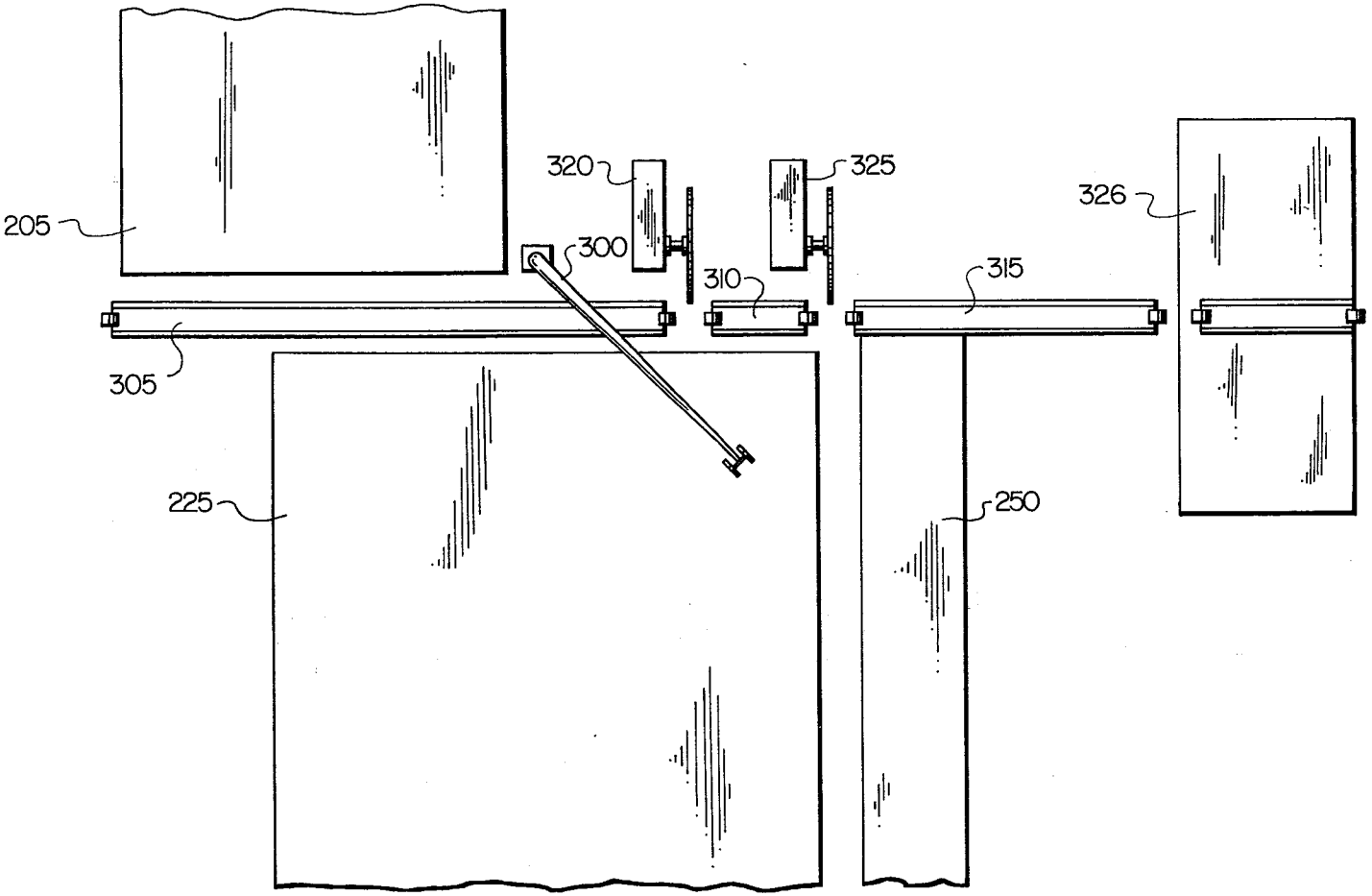
Figure 2B:
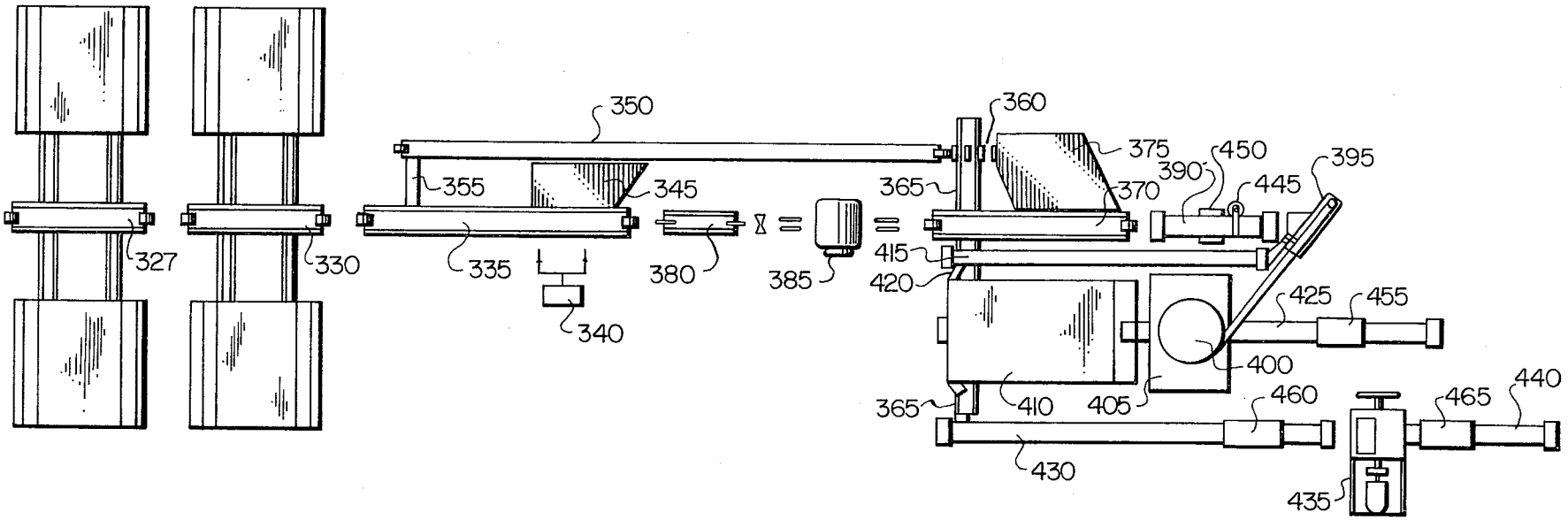
Figure 2C:
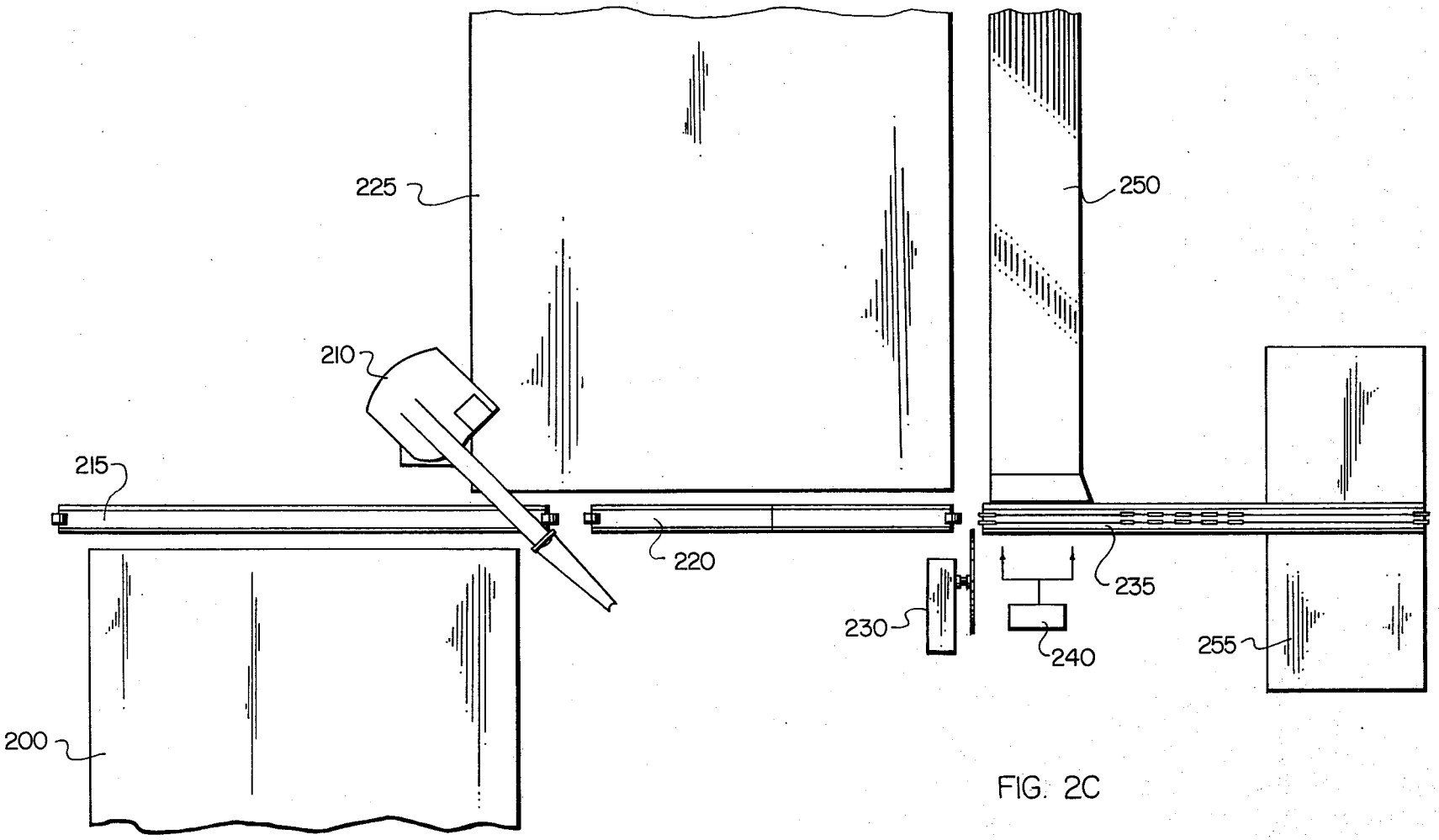

Referring now to FIG. 1, shown therein is a flow chart of the method according to this invention. In the flow chart of FIG. 1 an open arrow represents a transport step, an open circle an operation step, an open triangle a storage step and an open square an inspection step. Each of these symbols contains therein a number, and the following Table I describes the step associated with each of the numbered symbols.

TABLE I

| SYMBOL | DESCRIPTION | SYMBOL | DESCRIPTION |
|---|---|---|---|
| △ 1 | Large log and mixed log storage | □ 2 | Logs are inspected for size and type |
| ⇨ 1 | Logs enter system | ○ 9 | First small log sort |
| ○ 1 | First Separation | △ 11 | Large hardwood stored |
| ⇨ 3 | Logs smaller than 8" are sent to smal log side | △ 12 | Small hardwood stored |
| ○ 2 | Large logs are sawed to length and rejects removed | ○ 10 | Second small log sort |
| □ 1 | Cut to length large logs are inspected for size and type | △ 13 | Large pine stored |

TABLE I-continued

| SYMBOL | DESCRIPTION | SYMBOL | DESCRIPTION |
|---|---|---|---|
| 3 | First sort | 14 | Small pine stored |
| 3 | Pine pulpwood size logs are stored | 11 | Rejects are removed |
| 4 | 10" pine logs are stored | 5 | Rejects move to trash system |
| 4 | Second sort | 12 | Remaining small logs enter debarker |
| 5 | 12" pine logs are stored | 13 | Trash system is separated |
| 6 | 14" pine logs are stored | 6 | All material less than 5" from trash system goes to blower |
| 5 | Third sort | 16 | All material less than 5" is blown to cars |
| 7 | Hardwood pulpwood size logs are stored | 7 | All material larger than 5" re-enters small log system |
| 8 | Scrap pine stored | 15 | Material from small log system enters chipper |
| 6 | Fourth sort | 15 | Chipped material is stored |
| 9 | Hardwood saw logs are stored | 14 | Material from chipper is separated |
| 10 | Hardwood scrap stored | 9 | Material larger than 5" re-enters chipper |
| 2 | Small log storage | 8 | Material less than 5" goes to blower |
| 2 | Small logs enter small log side of system | 17 | Material is blown to cars |
| 7 | Cut-off saw cuts to length | 10 | Material goes to cars |
| 8 | Cut-off saw cuts to length | 11 | Material goes to cars |
| 4 | Scrap and pieces enter trash system | | |

It is seen from the flow chart of FIG. 1 and the descriptive material of Table I that there are basically three processing lines according to the principles of this invention. The first processing line is for large logs, the second for small logs and the third a scrap processing line. The dividing point for large logs and small logs is illustratively 8 inches; i.e., logs having a diameter less than 8 inches are processed on the small log line. These small logs may enter the system from either storage points 1 or 2, whereas the large logs may only enter from storage point 1. The mixed logs at storage 1 are transported to the system at transport step 1. Operation step 1 separates the mixed group of logs, the logs having diameters less than 8 inches being transported at transport step 3 to the small log processing line, where they join up with the logs transported to the small log processing line at transport step 2 from storage point 2. Continuing down the large log processing line, at operation step 2 the large logs are sawed to length and the rejects such as short sections of those logs or rotten logs are transported at transport step 4 to the trash processing system. At this point the cut lengths of large logs are ready for sorting and storing. At inspection step 1, the logs are inspected for sorting as to for example, size and type. At operation step 3 the logs are sorted and storage step 3 stores pine pulp wood size logs and storage step 4 stores 10 inch pine logs. The second sort is at operation step 4, storage step 5 storing 12 inch pine logs and storage step 6 storing 14 inch pine logs. The third sort takes place at operation step 5 where storage step 7 stores hardwood pulpwood logs and storage step 8 stores scrap pine. The fourth sort takes place at operation step 6 where storage step 9 stores hardwood saw logs and storage step 10 stores hardwood scraps. It is understood that the particular sorts described above are for illustrative purposes only. Different sorts may be performed depending upon the desired application. It is also understood that more or less sorting steps may be provided.

The small log processing line begins with operation steps 7 and 8 where cut-off saws cut the small diameter logs to the desired length. Scrap and short pieces enter the trash processing system at transport step 4. After the logs are cut, at inspection step 2 the logs are inspected for size and type. Operation step 9 is the first small log sorting step where storage step 11 stores the larger hardwood and storage step 12 stores the smaller hardwood. Operation step 10 is the second small log sorting step where storage step 13 stores the larger pine and storage step 14 stores the smaller pine. Any small logs which have not been previously rejected but do not fit into any of the above categories enter the trash system. At operation step 11, rejects go to the trash system via transport step 5 and undersized logs too small for lumber enter the debarker at operation step 12 for processing into paper pulp material. In the trash system, at operation step 13 the trash material is separated, with material less than 5 inches in size going to the blower via transport step 6 and material larger than 5 inches re-entering the small log system via transport step 7. At operation step 15, material from the small log processing system is chipped, the chipped material being stored at storage step 15. The stored chipped material is then separated at operation step 14 with material larger than 5 inches re-entering the chipper at transport step 9 and material less than 5 inches going to the blower at transport step 8. At operation step 16 the trash material less than 5 inches is blown to cars at transport step 10, and material from the chipper is blown to cars at operation step 17 and transport step 11.

Referring now to FIGS. 2A through 2D, the operation of apparatus to perform the method heretofore discussed will now be described. When logs are delivered to the mill, they may all be deposited directly on infeed deck 200. However, if the logs are all of the smaller size, such as less than 8 inches in diameter, they may all be deposited on deck 205. Loader 210 is utilized to place the logs from infeed deck 200 one by one in end to end relationship on cut-off saw infeed conveyor 215. The logs then travel to conveyor 220. Conveyor 220 is a dump conveyor illustratively of the type described in co-pending application Ser. No. 614,657, entitled "Log Sorting Conveyor", assigned to the assignee of this invention filed on even date herewith. Logs of the smaller diameter are then dumped by dump conveyor 220 onto transfer deck 225 while logs of the larger diameter travel to cut-off saw 230 where they are cut to desired lengths. The cut logs then travel to cut-off saw outfeed conveyor 235. Any scrap materials, such as short sections or rotten logs, are pushed from conveyor 235 by log kicker 240 onto reject slide 245 and then to conveyor 250.

The logs on conveyor 235 pass between the two booths of operator house 255. At this point the logs are scanned either by an operator or by commercially available equipment which electronically scans logs to determine their size. The logs then pass down the line of sort conveyors 260, 265, 270 and 275, which illustratively are dump conveyors of the aforementioned type. When a log reaches the point at which it is to be temporarily stored, the operator operates a sort conveyor to dump the log into the appropriate stack. For example, conveyor 260 corresponds to sort operation 3, conveyor 265 to sort operation 4, conveyor 270 to sort operation 5 and conveyor 275 to sort operation 6. Bin 280 then corresponds to storage operation 3, bin 285 to storage operation 4, etc.

The logs on infeed deck 205 and transfer deck 225 are picked up by loader 300 one by one and are placed in end to end relationship on conveyor 305. The logs then travel on conveyor 310 and conveyor 315 past two saws 320 and 325. Saws 320 and 325 are positioned 8 feet apart. A stop is provided on conveyor 315 which will halt the movement of the log at a point either 8 feet or 10 feet from saw 325. Thus, when saws 320 and 325 are simultaneously operated, either two 8-foot sections of log will be provided or one 8-foot section and one 10-foot section are provided. The cut sections of log then pass through operator house 326 where an operator sorts the logs by means of dump conveyors 327 and 330 in the same manner as previously described for the large log processing line. Log sections of smaller than usable diameter pass onto conveyor 335, where reject sections which are not to be made into paper pulp material are pushed by log kicker 340 onto reject slide 345 and then to conveyor 350.

The trash processing system parallels the small log processing system. Conveyor 250, carrying rejected pieces from conveyor 235 is coupled to a bark vibrator conveyor, not shown, beneath and parallel to conveyor 315. This bark vibrator conveyor continues below conveyors 325 and 330 and is coupled to a bark conveyor 355 which moves the rejected pieces to conveyor 350. The material on conveyor 350 is fed to grizzly rolls 360. The small pieces resulting from the action of grizzly rolls 360 fall to bark vibrator conveyor 365, the larger pieces going to conveyor 370 via slide 375. Meanwhile, the pieces on conveyor 335 transfer to conveyor 380 along which they are transported to debarker 385. The debarked material then is transported to bark vibrator conveyor 365. At this point, the large pieces of trash material are on conveyor 370 and the small pieces of trash material are on conveyor 365. The material on conveyor 370 is transferred to conveyor 390 where it goes to chipper 395.

The material that goes to chipper 395 is broken down and blown into cyclone 400 from which chips drop into chip surge bin 405. Chip surge bin 405 is a large container which acts as a buffer between chipper 395 and chip screen 410, having an auger in its bottom to meter the chips onto chip screen 410. Chip screen 410 separates over-size chips, acceptable chips and small particles. If chipper 395 generated a large quantity of chipped material in a short period of time, this would be too much for chip screen 410 to effectively separate. Therefore, the auger in chip surge bin 405 provides a uniform flow of chips to chip screen 410. The over-size chips from chip screen 410 are deposited on conveyor 415 via slide 420 and are transported back to chipper 395 for reprocessing. The acceptable chips from chip screen 410 are deposited on conveyor 425. The material on conveyor 425 is of the proper size to be used for the manufacture of paper pulp. The small particles from chip screen 410 are deposited on bark vibrator conveyor 365. Bark vibrator conveyor 365 transports the material thereon to conveyor 430 which takes the material to bark hog 435 where it is hogged into a material for a flash type burning fuel and placed on conveyor 440. The material on conveyors 425 and 440 are transported to respective blowers, not shown, for blowing into railroad cars, or the like, which are used to transport the material to suitable processing centers.

Several safety features to prevent machine damage are incorporated in the trash processing system. F-stop 445 is a device that is operatively connected to a demand meter on the motor that drives chipper 395. When a large log starts into chipper 395, the knives in the chipper are set to feed the log into it. If a long log starts into chipper 395 and the chipper motor becomes overloaded, conveyor 390 is automatically stopped and F-stop 445 comes down on the log to keep it from continuing to be fed into chipper 395. Metal detector 450 is set so that when it detects metal in a piece of wood, it stops conveyor 390 and activates F-stop 445. Magnets 455, 460 and 465 pull metal from material that is already chipped or hogged while allowing the respective conveyors to run.

It is thus evident that in accordance with the principles of this invention, logs entering a mill may be sorted into groups which will enhance the efficiency of the mill operation. In addition, preliminary processing of trash material, including bark and sawdust, results in commercially usable products which may be sold.

Whereas this invention has been described with respect to an embodiment thereof, it is understood that a person of skill in the art may make modifications thereto without departing from the spirit and scope of the invention.

What is claimed is:

1. A method for processing incoming logs to a mill, comprising the steps of:

providing a first processing line, a second processing line and a third processing line;

separating the incoming logs into a first group having greater than a predetermined diameter and a second group of lesser than said predetermined diameter;

transporting said first group to said first processing line;

transporting said second group to said second processing line;

processing said first group of logs in said first processing line by the steps of:

cutting the logs in said first group to desired lengths;

transporting short pieces to said third processing line; and sorting the logs of desired lengths according to a first group of predetermined characteristics;

transporting undesirable pieces from said second group to said third processing line; and processing the pieces in said third processing line to form material suitable for use as fuel and paper pulp.

2. The method according to claim 1 wherein said first group of predetermined characteristics includes ranges of log diameter.

3. The method according to claim 1 wherein said first group of predetermined characteristics include types of wood.

4. The method of claim 1 including the step of cutting logs of said second group into predetermined lengths.

5. The method of claim 1 wherein the predetermined diameter is about 8 inches.

6. The method of claim 1 wherein rotten logs are transported to said third processing line.

7. Apparatus for processing incoming logs to a mill to sort usable logs according to size and to form from unusable logs and pieces thereof scrap material suitable for fuel and paper pulp, comprising in combination:

a first processing line and a second processing line;

means for separating the incoming logs into a first group of larger than a predetermined diameter and a second group of the remainder and transporting said first group to said first processing line and transporting said second group to said second processing line;

scrap processing means positioned for receiving scrap material from said first and second processing lines for breaking down material presented thereto into material suitable for fuel and paper pulp;

said first processing line including:

first saw means for cutting the logs of said first group into desired lengths;

first rejection means down stream of said first saw means for presenting to said scrap processing means logs and pieces of said first group unsuitable as lumber; and first sorting means in said first processing line downstream of said first rejection means for sorting the cut logs of said first group according to log diameter groupings; and said second processing line including:

second saw means in said second processing line for cutting the logs of said second group into desired lengths; and second rejection means downstream of said second saw means for presenting to said scrap processing means all log pieces not having predetermined characteristics.

8. The apparatus of claim 7 further including means for introducing incoming logs of less than said predetermined diameter directly to said second processing line.

9. Apparatus as defined in claim 7 further including second sorting means for sorting the cut logs of said second group according to log diameter groupings.

10. Apparatus as defined in claim 7 wherein said saw means for cutting the logs of said second group selectively cuts a log into two substantially equal lengths or two substantially unequal lengths.

11. Apparatus as defined in claim 7 wherein said first and second processing lines each comprise a longitudinal conveyor means.

12. Apparatus as defined in claim 11 wherein each of said longitudinal conveyor means includes means for selectively removing lengths of logs from said conveyor means at selected locations.

13. Apparatus as defined in claim 7 wherein said saw means for cutting the logs of said second group includes first and second saws spaced apart a predetermined distance and stop means positioned for selectively stopping said logs at distance down stream from said second saw substantially equal to or different from said predetermined distance.

* * * * *